US005511248A

United States Patent [19]

Widdemer

[11] Patent Number: 5,511,248

[45] Date of Patent: Apr. 30, 1996

[54] ANTI-SLIP GLOVE

[75] Inventor: John D. Widdemer, Gloversville, N.Y.

[73] Assignee: Bali Leathers Inc., Johnstown, N.Y.

[21] Appl. No.: 409,696

[22] Filed: Mar. 24, 1995

[51] Int. Cl.[6] ..... A41D 19/00

[52] U.S. Cl. ..... 2/161.3; 2/163; 2/164

[58] Field of Search ..... 2/161.1, 161.2, 2/161.3, 161.8, 164, 167, 168, 169, 159, 158

[56] References Cited

U.S. PATENT DOCUMENTS

| | | | |
|---|---|---|---|
| 3,255,461 | 6/1966 | Bullock | 2/167 X |
| 4,569,707 | 2/1986 | Johnson | 2/167 X |
| 4,785,479 | 11/1988 | Watanabe | 2/167 X |
| 4,881,276 | 11/1989 | Swan | 2/167 X |
| 5,070,540 | 12/1991 | Bettcher et al. | 2/161.8 X |
| 5,075,144 | 12/1991 | Kakuwa | 2/161.3 X |
| 5,117,509 | 6/1992 | Bowers | 2/161.1 |
| 5,146,628 | 9/1992 | Herrmann et al. | 2/161.8 X |
| 5,164,231 | 11/1992 | Davis | 2/161.3 X |
| 5,390,372 | 2/1995 | Hashimoto et al. | 2/164 X |

*Primary Examiner*—C. D. Crowder
*Assistant Examiner*—Shirra L. Jenkins
*Attorney, Agent, or Firm*—Aufrichtig Stein & Aufrichtig

[57] ABSTRACT

An improved design for an anti-slip glove is disclosed. The surface of the glove is adapted to provide an especially strong bond between the palm and/or fingers of the glove and the club, racket or other piece of sports equipment which the athlete is holding, pulling or pushing. The improved anti-slip glove utilizes a thermoplastic polyurethane film panel, incorporated into the glove's design at key pressure points, which is selected to exhibit a strong physical bond with the rubber, plastic, leather or other composite materials used to manufacture the hand grips that are a part of hand-held sporting equipment. The anti-slip panel may be attached separately to the palm and fingers of the glove or made an integral part of the glove. When made an integral part of the glove's design and manufacture, the improved anti-slip glove may also incorporate a non-slip backing material positioned between the wearers hand and the rear surface of the thermoplastic polyurethane film panel, to provide a tight coupling between the surface of the wearers hand and the body of the glove to reduce slippage of the hand within the glove.

19 Claims, 2 Drawing Sheets

ANTI-SLIP GLOVE

BACKGROUND OF THE INVENTION

This invention relates, in general, to the field of glove design and, more particularly, to an improved sports glove which is adapted to provide an especially strong bond between the palm and/or fingers of the glove and the club, racket or other piece of sports equipment which the athlete is holding or pulling or pushing. The improved anti-slip glove utilizes a thermoplastic film panel, incorporated into the glove's design at key pressure points, which is selected to exhibit a strong physical bond with the rubber, plastic, leather or other composite materials used to manufacture the hand grips that are a part of hand-held sporting equipment. The anti-slip panel may be attached to the palm and fingers of the glove or made an integral part of the glove. When made an integral part of the glove's design and manufacture, the improved anti-slip glove may also incorporate a non-slip backing material positioned between the wearers hand and the rear surface of the thermoplastic film panel, to provide a tight coupling between the surface of the wearers hand and the body of the glove to reduce slippage of the hand within the glove.

In many activities gloves are worn to protect the wearers hands from injury. Gloves are also frequently worn to keep a wearers hands from slipping on the item being pulled, pushed or held. This is especially true when wearer is looking for 'positive traction' against an otherwise potentially slippery object. One area where gloves have been worn for both protection as well as increased security of contact is the field of sporting gloves.

Baseball, bicycling, handball, tennis and weight lifting are all sports where at least one glove is frequently worn by an athlete, usually not for protection against the elements, but for protection against shock and vibration and to provide a surer grip on the bat, racket or other object being held. In addition, the sport of golf is also an excellent example of a sport where the use of a glove has become so widespread that the golf glove is accepted almost universally as a necessary piece of sporting equipment.

A review of any popular golfing magazine will illustrate the degree to which the golf glove has become a standard accessory. It is almost impossible to find a photograph or illustration of a golfer not wearing a golf glove. In addition, a trip to any sporting goods store will provide an opportunity to examine a wide range of golf gloves manufactured in many different styles incorporating many different materials.

The reason for this widespread use is the recognized critical importance surrounding the way a golf club is held and exactly how it is swung. Since even a small correction in the manner in which a player holds his or her club may dramatically improve shot distance and accuracy, a great deal of attention is paid to the mechanics of holding a golf club. However, while it is well understood that a properly designed golf glove may provides a stable interface between the players hand and the golf club grip, and while many different golf gloves are currently available, they are all, fundamentally, the same, being constructed of leather or vinyl and designed to provide a sure, secure, dry grip on the club's handle.

At the same time that golf glove design has continued apace, parallel efforts have been put into experimentation with the composition of materials used to create a golf club's grip. Today, every major golf club manufacturer has devoted a great deal of research and development into the design and production of composite grips. These modern grips are no longer made of hard smooth leather, but are comprised of advanced rubber and polymer mixtures, which are designed to provide added cushioning to the grip area while also yielding surer contact with the golfers hands and, thereby, increased club control.

Unfortunately, though golf club grips have benefited from these advanced materials advances, there has, to date, not yet been developed an improved golf glove which is specifically designed to take advantage of the composite rubber materials used in modern golf club grips in order to provide a golf glove which is especially adapted to exhibit exceptional mating characteristics when used in conjunction with modern rubber composite rubber grips.

Accordingly, it has been determined that the need exists for an improved anti-slip glove which may be employed as a golf glove, and which is especially adapted to provide a strong bond between the wearers hand and the composite material used to fabricate a modern golf club grip.

SUMMARY OF THE INVENTION

Generally speaking, in accordance with the invention, an improved anti-slip glove is provided. The glove is constructed using materials which are especially adapted to provide a strong, but temporary, adhesion between the palm and/or finger surface of the glove and the object which is desired to be pulled, pushed or held.

In one embodiment, the improved anti-slip glove is adapted for use as a golf glove. In this configuration, the anti-slip glove incorporates one or more series of anti-slip panels constructed of a elastomer super tacky film. This elastomer film surface exhibits exceptional mating characteristics with the composition rubber grip used in modern golf gloves, resulting in a temporary, but "vise like" grip.

Though the elastomer film may be added as a separate panel, or series of panels, to a traditionally constructed glove, in the preferred embodiment the film is an integral part of the palm and/or thumb and/or fingers. By proper placement, improved gripping forces may be provided to the finger areas while resistance against sliding may be provided to the thumb area.

Since the elastomer film will generally be deposited in a thin layer, not structurally strong enough to physically withstand the rigors of extended use (particularly since according to the invention there will be a great bond and, subsequently the application of great forces to the surface of the elastomer film), it is anticipated that the film will be bonded, for example through a heat bonding process, to a suitable backing material. This material may be any suitable fabric, such as a polyester.

In practice, the bonded sandwich of elastomer film and backing material is incorporated as a panel which is an integral part of the glove body. Since the backing material may, itself, not provide a stable enough coupling between the wearers hand and the internal surface area of the glove, in a further embodiment to the invention it is disclosed to provide an embossed or otherwise raised non-slip surface to the backing material to prevent slippage of the elastomer film/backing fabric base against the skin.

Finally, yet an additional improvement is provided in that in many cases the elastomer film will have a natural reaction with the composite rubber of the golf grip in use, resulting, during play, in the creation of a personal "x-ray". This image will appear on the palm, finger and or thumb surface and may be read by a professional to help interpret how a golfer is holding their club and how they might best adjust their grip. Incorporating this element, a poor grip will show up in 'dark areas' or in areas of misplaced contact.

In summary, then, according to the teachings of the invention an improved anti-slip glove may be provided which is especially suited for use, for example, as a golf glove. The anti-slip glove acknowledges the special composition of the grip area used in modern sporting goods, and incorporates an anti-slip panel (or panels) fabricated from an elastomer film which exhibits exceptional temporary mating characteristics with the composite of the grip, resulting in a strong, non-skid bond. In a preferred embodiment, the elastomer film is bonded to a backing material, such as polyester fabric, and this sandwich is used to form at least a portion of the palm, finger or thumb area of the anti-slip glove. In a further refinement to the invention the side of the polyester fabric which is not in contact with the elastomer film is embossed or otherwise treated to yield a ribbed 'grip' pattern which provides increased stability against movement of the wearers hand within the glove. In addition, where the physical/chemical reaction between the surface of the elastomer and the grip composite results in the highlighting of contact points as a form of 'x-ray', in practice the improved anti-slip glove may be used as a diagnostic tool to understand how a golfer is gripping their club, and what corrections might be taken to arrive at a better grip.

Accordingly it is an object of the invention to provide an improved anti-slip glove which overcomes the limitations of the prior art.

It is another object of the invention to provide an improved anti-slip glove which will temporarily adhere to the object which the glove is in contact with.

It is a further object of the invention to provide an improved anti-slip glove in which the anti slip properties are incorporated into the thumb area in order to enhance the ability to push.

It is an additional object of the invention to provide an improved anti-slip glove in which the anti-slip properties are incorporated into the finger area or palm areas in order to enhance the ability to grab.

It is yet another object of the invention to provide an improved anti-slip glove in which the anti-slip surface is attached to an existing glove.

It is yet a further object of the invention to provide an improved anti-slip glove in which the anti-slip surface is an integral part of the palm part or thumb part of the glove.

It is yet an additional object of the invention to provide an improved anti-slip glove in which the anti-slip material is bonded to a backing material which is adapted to reduce movement of the human hand within the glove.

It is still another object of the invention to provide an improved anti-slip glove in which the anti-slip material is adapted to visibly illustrate the points of contact between the glove and the object being held, pulled or pushed.

It is still a further object of the invention to provide an improved anti-slip glove which is comfortable to wear and attractive to view.

It is still an additional object of the invention to provide an improved anti-slip glove which may be lightweight for use in sports.

It is also another object of the invention to provide an improved anti-slip glove which is inexpensive to manufacture.

Still other objects and advantages of the invention will, in part, be obvious and will, in part, be apparent from the specification.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENTS

Figure 1:
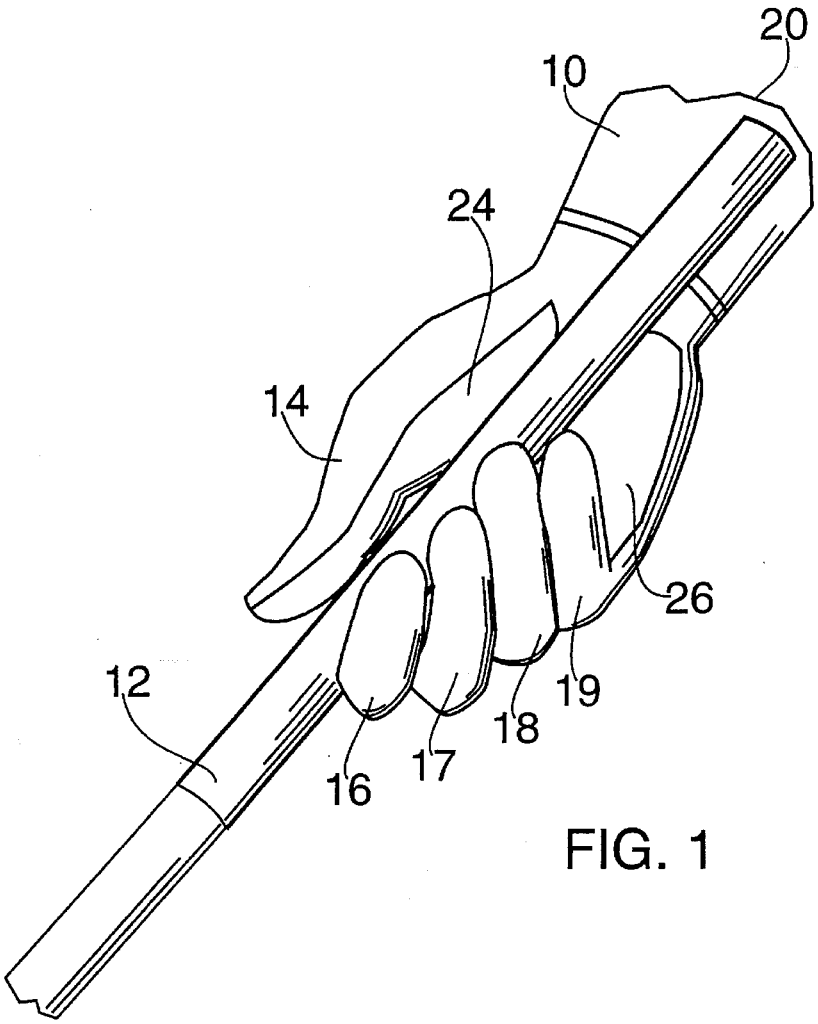
FIG. 1 is an illustration of a hand wearing the glove of the instant invention holding a golf club.

Referring first to FIG. 1, an illustration of a hand wearing an anti-slip glove constructed in accordance with the instant invention is shown. In FIG. 1 the hand wearing the glove is holding the shaft of a golf club for the purpose of highlighting the multiple areas of contact which occur between the palm, thumb and fingers of a golf glove and the shaft of the club being held.

The glove, generally referred to as 10, is shown being worn by a wearer (unseen) who has inserted their hand in through glove opening 20. The glove is formed in a traditional shape and includes a thumb part 14, a palm part or conventional back part (not shown) 15, a conventional back part (not shown) and four fingers 16, 17, 18 and 19. Panels of the polymeric film sandwich taught by the invention are incorporated into the thumb 14 as a thumb panel 24, and into the palm part 15 as a palm panel or anti-slip panel member 26, extending up fingers 17, 18 and 19.

As illustrated, the forces exerted by the wearers hand on the golf club shaft may be described as complex, in that during play the surface of the gloved hand makes contact with the shaft at a number of different points, including contact with the thumb 14, contact with the palm 15 and contact with each of the four fingers 16, 17, 18 and 19. What makes this contact especially difficult to control is that each point of contact generates a force in a different direction. For example, in general, the thumb 14 will exert a pushing force, or motion, against the golf club shaft 12 towards the club head, while the fingers 16, 17, 18 and 19 and palm part 15 will exert a gripping or squeezing force. Accordingly, in constructing the improved glove, the location, size and shape of anti-slip panels will depend on the desirability of increasing the force which may be exerted by the gloved hand in any particular direction.

Figure 2:
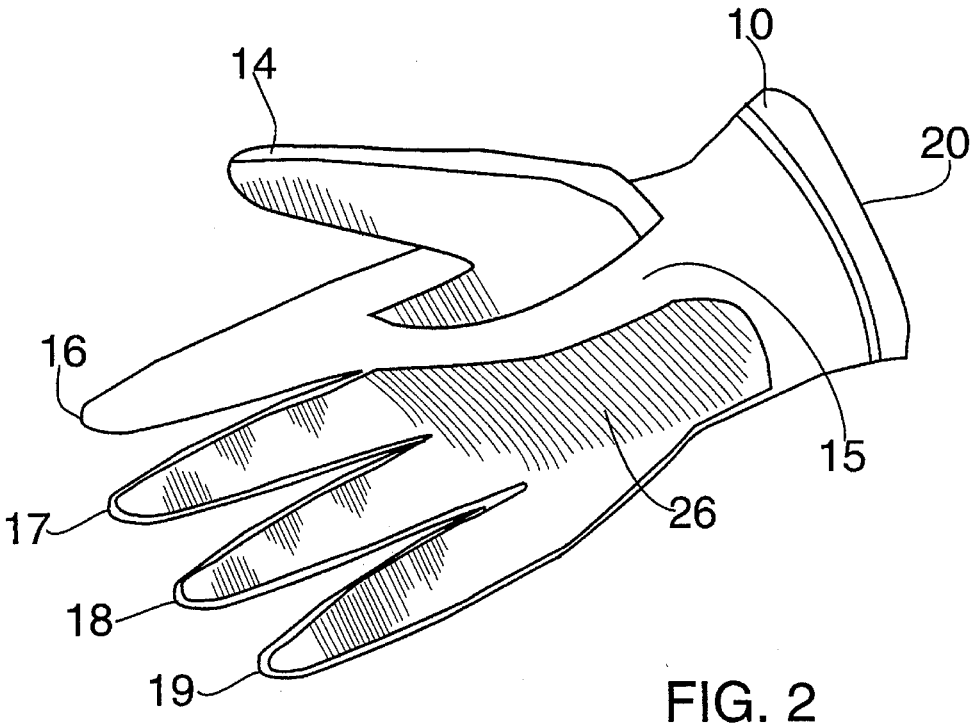
FIG. 2 is an illustration of one embodiment of the glove of the instant invention showing those areas which are fabricated using a polymeric film.

Turning then to FIG. 2, an open palm facing view of a golf glove constructed in accordance with the invention is shown. As can be seen more clearly in FIG. 2, the glove is conventional in its overall appearance with the addition of thumb panel 24 and palm panel 26. FIG. 2 shows these panels in relation to the rest of the glove body. As illustrated, thumb panel 24 is disposed along the ball of the hand beneath the base of the thumb 14 and extends upward to the tip of the thumb. Palm panel 26 is disposed along the outer side of palm part 15 extending toward the center of the palm and then upwards to the tips of the third, fourth and fifth fingers of the hand.

As can be clearly seen, in the preferred embodiment of the invention the index finger does not incorporate any portion of either the thumb panel or the palm panel. This omission is intentional since by following the construction illustrated the gloved hand is permitted to fold naturally along the crease between the thumb and fingers without being impeded by any material within the crease which could reduce control and thereby affect performance. In addition, since in the sport of golf the index finger is generally laid along the players opposing hand and, therefore, would not require, nor derive, the benefits offered by the anti-slip material, the elimination of the additional panel assists in cost reduction.

It is anticipated that this construction might be altered, depending on the style of club used or preferences of the player. For example, in one alternate embodiment all four fingers may incorporate the polymeric sandwich, while in another the polymeric material might be eliminated from the thumb piece which would, instead, be replaced with a standard leather and padding construction. These, and other choices of shape and placement may be made by glove designers under the invention without departing from its scope.

Figure 3:
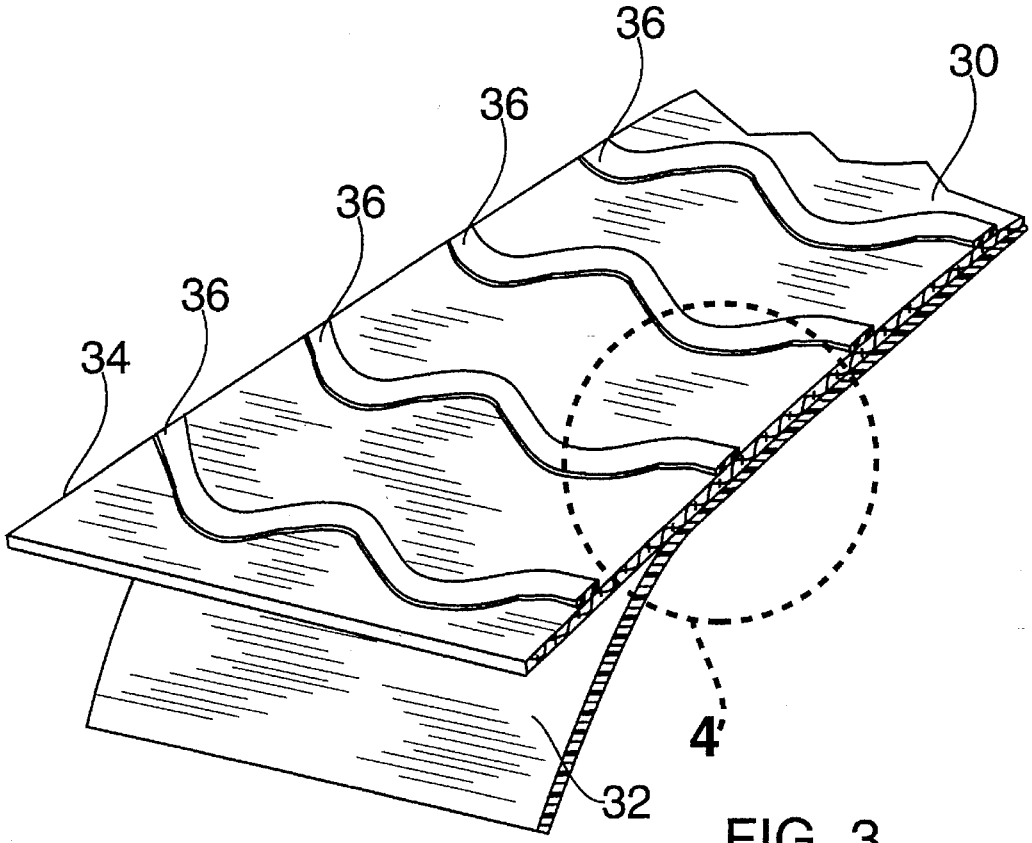
FIG. 3 is a cross-sectional illustration of the polymeric film of the invention attached to backing material where the backing material is adapted to create a non-slip bond with the wearers skin.
Figure 4:
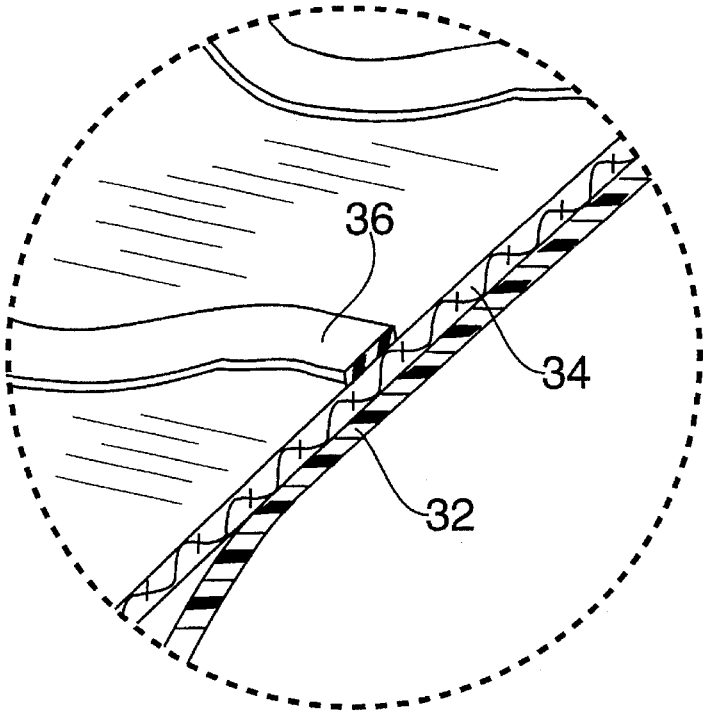
FIG. 4 is an enlarged cross-sectional illustration taken at area 4 of FIG. 3.

Turning, then, to FIGS. 3 and 4, the actual construction of the anti-slip sandwich is disclosed and discussed. As shown the anti-slip sandwich is referred to, generally, as 30. This sandwich comprises three distinct components: a polymeric film 32; a backing material 34; and an anti-slip pattern 36 disposed on the backing material 34. The polymeric film incorporated into the preferred embodiment is PS7000.003 MIL DURAFLEX, a thermoplastic polyurethane film manufactured by Deerfield Urethane, a division of Miles Laboratories. In practice, the surface of the polymeric film, when coupled to a rubber composite grip, will form a very strong, but removable, bond. This bond is created because of the physio-chemical reaction which occurs between the surface of the film and the surface of the rubber composite, and while the polymeric/rubber bond is the present subject of this invention, it is anticipated that the invention also be extended to cover similar constructions where an anti-slip material is chosen specifically because it may be firmly, but removably, bonded to the material which is used to construct the item being gripped or held.

Turning to the backing material, in the preferred embodiment this element is chosen to be a knitted polyester fabric, such as Lycra, or even more preferably, a microfibre nylon or other fibre to which the polymeric film may be bonded. With the microfibre fabric, the microfibres appear to create a better bond with the polymeric film 32. In one embodiment this bonding occurs through a heat/pressure process where the polymeric film 32 and the backing material 34 are subjected to rollers which supply approximately 2,200 lbs. of pressure at temperature of 400° F. The pressure is necessary to assure that the bonding is evenly and fully done. The temperature may be selected to be from about 180° F. up to just below the melting point of the film. In a preferred embodiment, the temperature closer to 400° F. and preferably at 400° F. provides a superior bond which does not delaminate during use. It is important that the combination of polymeric film and polyester backing material be chosen such that the film/backing composite does not delaminate, or come apart under normal wear and use.

While, depending upon the thickness and application, it is further anticipated that the polymeric or anti-slip film 32 might be used without a backing material, in practice it is likely that a backing material will be used to provide increased structural strength. Unfortunately, in practice it has been found that many suitable backing fabrics have a slippery inner surface. This means that, whereas the use of a polymeric film surface will provide tight coupling between the surface of the golf glove and golf club, the slippery nature of the unbonded side of the backing material, which will be positioned next to the wearers hand, will result in a glove which has a strong bond to the glove club and a weak bond to the golfers hand.

Accordingly, the invention includes a further improvement designed prevent slippage of the film/fabric base against the skin. As illustrated in FIGS. 3 and 4, in the preferred embodiment of the invention a 'tacky' or otherwise rough or sticky pattern 36 is embossed, affixed or otherwise made a part of the surface of the backing material 34 which is not bonded to the polymeric film 32. This pattern 36 may be formed from vinyl, rubber or any other suitable material or series of members which exhibits resistance when moved against the surface of the skin.

In use, then, a golfer puts on the glove prior to playing a round of golf. In putting on the glove, the golfers hand fits inside the body of the glove and the golfers palm contacts the backside of the backing material. The raised pattern on the backing material generates friction against the hand, helping to keep the hand stable and secure within the glove body. In the process of play, then, the golfer uses the glove to hold a golf club along its composite rubber grip. The golfer wraps their hands around the grip and this results in a strong, secure bond being set up between the surface of the golf club grip and the surface of the polymeric film. This exceptional bond thus helps to insure that throughout the swing of the club, the shaft of the golf club will not twist or turn, resulting in more precise control over the swing and, ultimately, over the ball.

Returning for a moment to FIG. 1, an additional benefit is derived through the use of the anti-slip glove which takes advantage of the physio-chemical reaction which occurs when the polymeric film of the glove 10 contacts the rubber grip of the shaft 12. It is noted that elastomer polymeric films frequently undergo a natural reaction when placed in contact with composite rubber. This reaction results in a temporary image, or 'x-ray' being created on the surface of the polymeric film indicative the stress points, or point of contact, between the grip and the glove. By using this 'x-ray', the glove of the invention may be used by a golf professional to help the golfer 'read' the grip and make the necessary adjustments. Since a poor grip will show up as dark areas or in areas of undesired contact, by referring to this semi-permanent record, immediate correction can be made.

Although the polymeric material described above is generally clear, it is anticipated in a modification to the invention that a dye may be added, prior to or during the heat bonding process, allowing for the color of the polymeric sandwich to be altered. In addition, while the above provided description is limited to a single golf glove, it is anticipated that multiple gloves could be used at the same time. It is also anticipated that while the polymeric material described above is chosen for its ability to bond to the rubber composite material found in golf club grips, the invention may be modified such that the material used to form the surface of the anti-slip sandwich is selected to provide a bond against the material used by, for example, manufacturing the hand grip of the item being held out of a material which bonds with the polymeric material. Furthermore, while the preceding discussion has been directed to sports gloves, an improved anti-slip safety glove to be used in construction or as a utility glove could also be developed which would allow a workman to maintain a safe, secure grip on, for the example, the handle of his hammer or her wrench or saw (assuming the handle of the tool was properly prepared).

In conclusion, then, by incorporating the teachings of the invention an improved anti-slip glove may be provided which is especially suited for use, for example, as a golf glove. The anti-slip glove works in conjunction with the special composition of the grip material used in modern sporting goods, and incorporates an anti-slip panel (or panels) fabricated from an elastomer film which exhibits exceptional temporary mating characteristics with the composite of the grip, resulting in a strong, non-skid bond. In a preferred embodiment, the elastomer film is bonded to a backing material, such as a polyester fabric, and this sandwich is used to form at least a portion of the palm, finger and thumb area of the anti-slip glove to provide enhanced contact during pulling, pushing and holding. In a further refinement to the invention the side of the polyester fabric which is not in contact with the elastomer film is embossed or otherwise treated to yield a ribbed 'grip' pattern which provides increased stability against movement of the wearers hand within the glove. In addition, since, in practice, the physical/chemical reaction between the surface of the elastomer and the grip will often result in the highlighting of contact points, yielding a type of pressure 'x-ray', the improved anti-slip glove may be used as a diagnostic tool to understand how a golfer is gripping their club, and what corrections might be taken to arrive at a better grip Accordingly, it will thus be seen that the objects set forth above, among those made apparent from the preceding description are efficiently attained and, since certain changes may be made in the above constructions without departing from the spirit and scope of the invention, it is intended that all of the matter contained in the above description or shown in the accompanying drawings, shall be interpreted as illustrative, and not as limiting.

It will also be understood that the following claims are intended to cover all of the generic and specific features of the invention, herein described, and all statements of the scope of the invention which, as a matter of language, might be said to fall there between.

What is claimed is:

1. An improved anti-slip glove, for being worn on a human hand, comprising:

a palm part formed generally in the shape of a human hand and further defining a plurality of fingers;

a back part, connected to said palm part, formed generally in the shape of a human hand and being further formed in an approximate mirror image of said palm part;

a thumb part formed generally in the shape of a human thumb and connected to at least a portion of said palm part;

an anti-slip panel member affixed to at least a portion of said palm part, said anti-slip panel member selected to exhibit adhesive characteristics when brought in contact with the surface of an object the anti-slip glove is designed to be used to hold wherein;

said anti-slip panel comprises an anti-slip film surface and a backing material.

2. The improved anti-slip glove, as claimed in claim 1, wherein said anti-slip film surface and said backing material are bonded together through a heat and pressure lamination process.

3. The improved anti-slip glove, as claimed in claim 1, wherein said anti-slip panel is formed to be an integral part of said palm part such said backing material is in direct contact with said anti-slip film surface and said human hand.

4. The improved anti-slip glove, as claimed in claim 3, wherein said backing material further comprises a bonding surface and a frictional surface, said bonding surface being adapted to provide a permanent bond with the anti-slip film surface of said anti-slip panel; and said frictional surface being configured to provide resistance when moved across the surface of human skin.

5. The improved anti-slip glove, as claimed in claim 4, wherein said frictional surface further comprises a series of members connected to and rising above the frictional surface of said backing material.

6. The improved anti-slip glove, as claimed in claim 5, wherein said members are formed from a thermoplastic.

7. The improved anti-slip glove, as claimed in claim 5, wherein said thermoplastic is vinyl.

8. The improved anti-slip glove, as claimed in claim 1, wherein said anti-slip panel is coupled to the surface of said palm part.

9. The improved anti-slip glove, as claimed in claim 1, wherein said anti-slip panel extends from a point proximate the base of said palm part to an area proximate at least one of said fingers.

10. The improved anti-slip glove, as claimed in claim 1, wherein said anti-slip panel extends from point proximate the base of said palm part to an area proximate all of said fingers.

11. The improved anti-slip glove, as claimed in claim 1, wherein said anti-slip panel is further positioned from a area proximate the base of said thumb part to an area proximate the tip of said thumb part.

12. The improved anti-slip glove, as claimed in claim 1, wherein said anti-slip film surface comprises a thermoplastic polyurethane film.

13. The improved anti-slip glove, as claimed in claim 12, wherein said thermoplastic polyurethane film is dyed.

14. The improved anti-slip glove, as claimed in claim 12, wherein said thermoplastic polyurethane film exhibits a visual indication of each point of contact between said anti-slip film surface and the surface of the object the anti-slip glove is designed to be used to hold.

15. An improved anti-slip sports glove, comprising;

a palm part formed generally in the shape of a human hand and defining four fingers;

a back part formed generally in the shape of a human hand, said back part being formed in an approximate mirror image of said palm part;

a thumb part formed generally in the shape of a human thumb and being at least partially affixed to said palm part; and an anti-slip panel member, said anti-slip panel member being formed as an integral part of said palm part and extending up at least two of the four fingers defined by said palm part, said anti-slip member further comprising an anti-slip film surface and an anti-slip backing material, said anti-slip backing material comprising a bonding surface and a frictional surface, said bonding surface being permanently affixed to said anti-slip film surface, said frictional surface being in contact with said human hand and exhibiting resistance to movement across the surface of said human hand;

said anti-slip panel member exhibiting temporary adhesive characteristics when brought into contact with the handle of the sports equipment being held.

16. The improved anti-slip sports glove, as claimed in claim 15, wherein said frictional surface of said backing material further comprises a series of resistance members connected to and rising above the frictional surface of said backing material.

17. The improved anti-slip sports glove, as claimed in claim 16, wherein said resistance members are formed from a vinyl thermoplastic.

18. The improved anti-slip sports glove, as claimed in claim 15, wherein said anti-slip film surface is formed from a thermoplastic polyurethane.

19. The improved anti-slip sports glove, as claimed in claim 18, wherein said thermoplastic polyurethane film exhibits a visual indication of each point of contact between said anti-slip film surface and the surface of the object the anti-slip glove is designed to be used to hold.

* * * * *